US007740060B2

(12) United States Patent
Persson

(10) Patent No.: US 7,740,060 B2
(45) Date of Patent: Jun. 22, 2010

(54) METHOD AND DEVICE AT ROCK DRILLING

(75) Inventor: Lars Persson, Örebro (SE)

(73) Assignee: Atlas Copco Rock Drills AB, Orebro (SE)

( * ) Notice: Subject to any disclaimer, the term of this patent is extended or adjusted under 35 U.S.C. 154(b) by 247 days.

(21) Appl. No.: 12/084,593

(22) PCT Filed: Nov. 7, 2006

(86) PCT No.: PCT/SE2006/001264

§ 371 (c)(1),
(2), (4) Date: May 6, 2008

(87) PCT Pub. No.: WO2007/055637

PCT Pub. Date: May 18, 2007

(65) Prior Publication Data

US 2009/0107727 A1 Apr. 30, 2009

(30) Foreign Application Priority Data

Nov. 14, 2005 (SE) ..... 0502497

(51) Int. Cl.
*E21B 19/16* (2006.01)
*E21B 19/00* (2006.01)

(52) U.S. Cl. ..... 166/77.51; 166/377; 175/51

(58) Field of Classification Search ..... 166/77.51, 166/377, 178; 175/51, 57
See application file for complete search history.

(56) References Cited

U.S. PATENT DOCUMENTS

| | | | | |
|---|---|---|---|---|
| 3,986,569 | A | 10/1976 | Hilding et al. | |
| 4,194,579 | A | 3/1980 | Bailey et al. | |
| 5,361,831 | A | 11/1994 | Young | |
| 7,322,430 | B2 * | 1/2008 | Littlely | 175/51 |

FOREIGN PATENT DOCUMENTS

| | | |
|---|---|---|
| CL | 984-92 | 9/1992 |
| CL | 426-96 | 2/1997 |
| WO | 03033858 | 4/2003 |

* cited by examiner

*Primary Examiner*—Giovanna C Wright
(74) *Attorney, Agent, or Firm*—Mark P. Stone

(57) ABSTRACT

Slacking off device (24) for use on a drilling device (2) for rock drilling. The drilling device (2) comprises a rock drill (4) to which a drill string (10) is adapted to be jointed by means of a thread joint. The drill string (10) comprises an arbitrary number of drill rods (12, 14, 16) which are adapted to be jointed together by means of thread joints. The drilling device (2) comprises a driving device for forward and back rotation of the drill string (10). The slacking off device (24) comprises a clamping device (25) arranged to clamp up the drill string (10) and a separate striking device (33) arranged to strike with an angle towards the longitudinal direction of the drill string (10) of principally 75°-105° on a first (32) of any of said thread joints under back rotation so that an impressed torque on the drill string (10) is obtained in a thread slacking rotation direction to provide slacking of the first thread joint (32).

25 Claims, 3 Drawing Sheets

METHOD AND DEVICE AT ROCK DRILLING

TECHNICAL FIELD

Figure 1:
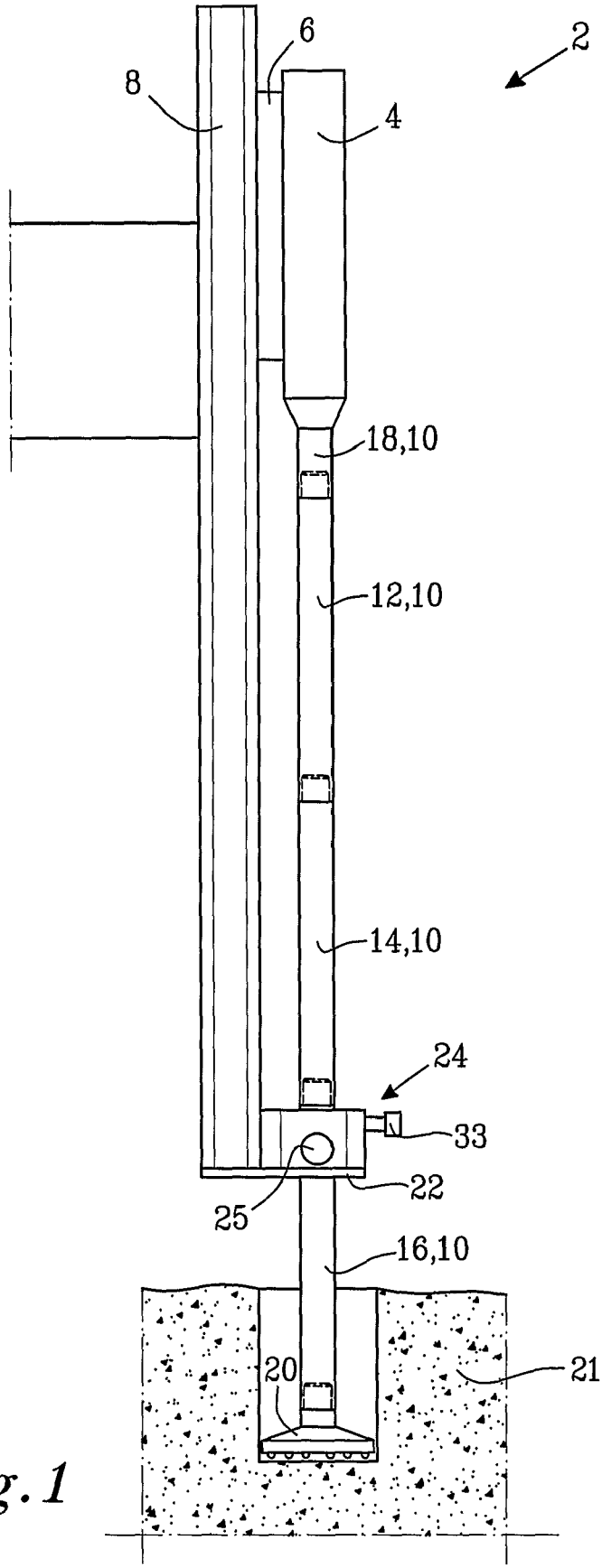

The present invention relates to a slacking off device for use at a drilling device for rock drilling, a drilling device for rock drilling, and a method for slacking a thread joint at rock drilling with the drilling device, especially adapted to simplify slacking off of drill rods at rock drilling.

BACKGROUND

Drill rods are rods that usually have a male thread in one end and a female thread in the other end. A common drill rod may be 6 m long but may extend to up to ca 10 meters. A number of drill rods, that have been jointed by screwing the male thread in a drill rod together with the female thread in the adjacent drill rod in thread joint, form a drill string whose length commonly is 50 meters long, up to 100 meters. One end of the drill string culminates in a drill bit which drills into the rock when it strikes and rotates. The other end of the drill rod is jointed to a driving device via a shank adapter. At operation the drill string strikes and is rotated by means of the driving device that is arranged on a drill rig from which the drill string projects. When almost all of the drill string is drilled into the rock, the drill string is lengthened with one drill rod at a time by slacking the drill string from the shank adapter and screwing another drill rod on the other end of the drill string and the shank adapter.

At drilling with high torques on the drill string a strong tightening of the thread joints of the drill string is often obtained. To be able to slacken these thread joints, the striking apparatus is allowed to continue to strike on the drill string in axial direction after drilling of the hole has been completed to shake loose the first thread joint to be slackened, i.e. the thread joint that joints the shank adapter with its closest drill rod. This leads to large loadings on drill rig, feeding beam, drill and drill steel. In addition is not sure that the drill rod that is closest to the shank adapter slackens off, but that another rod joint that is inside the rock. There is then a risk that parts of the drill string are lost, especially if the drilling takes place downwards the rock and the drill string is affected by the gravitation. This is a time consuming process that requires a large torque in back rotation in order for the drill string to slacken off.

WO0201041 discloses a method to slacken joints in drill steel in a drilling device. At slacking the pressure from a striking device on the drill steels and the joint receives a gentle axial impact as mentioned above. The drill steel is held simultaneously as it is rotated.

WO 03/033858 shows a striking device with a striking head, which striking device is adapted to reduce torque between two jointed drill rods at slacking off. The device is manually turned to the drill rods to be slackened and manually damped around these by an operator. The device clamps around the jointed drill rods from two diametrically different directions. This is done by a transferring arm on the striking device pressing on the jointed drill rods against the very striking head on the striking device by means of a coil spring. The striking head, i.e. one of the clamping points then strikes with radial strikes against or close to the joint to decrease the tensions that result due to deformations in the joint. The drill steels are then relatively rotated and thereby detached. This is a complicated device that must be manually handled. In addition it is difficult to achieve stability since one of the clamp points also is strike point, which means that the clamping power decreases when the striking head is on its way back and until a new strike comes. This may also imply a risk that parts of the drill string are dropped, especially if the drilling takes place downwards the rock and is affected by the gravity.

SUMMARY OF THE INVENTION

It is therefore an object of the present invention to provide a slacking off device that is simple, has an increased stability and that is suitable for automatization.

In accordance with the present invention this object is achieved by a slacking off device for use on a drilling device for rock drilling. The drilling device comprises a rock drill to which a drill string is adapted to be jointed by means of a thread joint. The drill string comprises an arbitrary number of drill rods that are adapted to be jointed together by means of thread joints. The drilling device also comprises a driving device for forward and back rotation of the drill string. The slacking off device comprises a damping device arranged to damp up the drill string, and a separate striking device adapted to strike with an angle towards the longitudinal direction of the drill string of principally 75°-105° on a first of any of said thread joints under back rotation so that an impressed torque on the drill string is obtained in a thread slacking rotation direction to provide slacking of the first thread joint.

In accordance with the present invention this object is also achieved by a drilling device for rock drilling. The drilling device comprises a rock drill to which a drill string is adapted to be jointed by means of a thread joint. The drill string also comprises an arbitrary number of drill rods that are adapted to be jointed together by means of thread joints. The drilling device comprises a driving device for forward and back rotation of the drill string and a slacking off device with the features disclosed above.

In accordance with the present invention this object is also achieved by a method for slacking a thread joint at rock drilling with a drilling device. The method comprises the steps of: a drill string is damped up by means of a damping device, a striking device strikes on the drill string in the area of a first thread joint to be slackened and the drill string is exposed to a moment in a thread slacking rotation direction.

Since the slacking off device comprises a damping device and a separate striking device the damping device will clamp around the drill string in one place and the striking device will strike on the drill string in another place. This means that an increased stability will be obtained when striking the drill string for slacking off of the thread joint, the risk of dropping the drill string will be decreased simultaneously as the device is relatively simple and well adapted for automatzation.

SHORT DESCRIPTION OF THE DRAWINGS

FIG. 1 is a schematic side view of a drilling device for rock drilling according to the present invention.

Figure 2A:
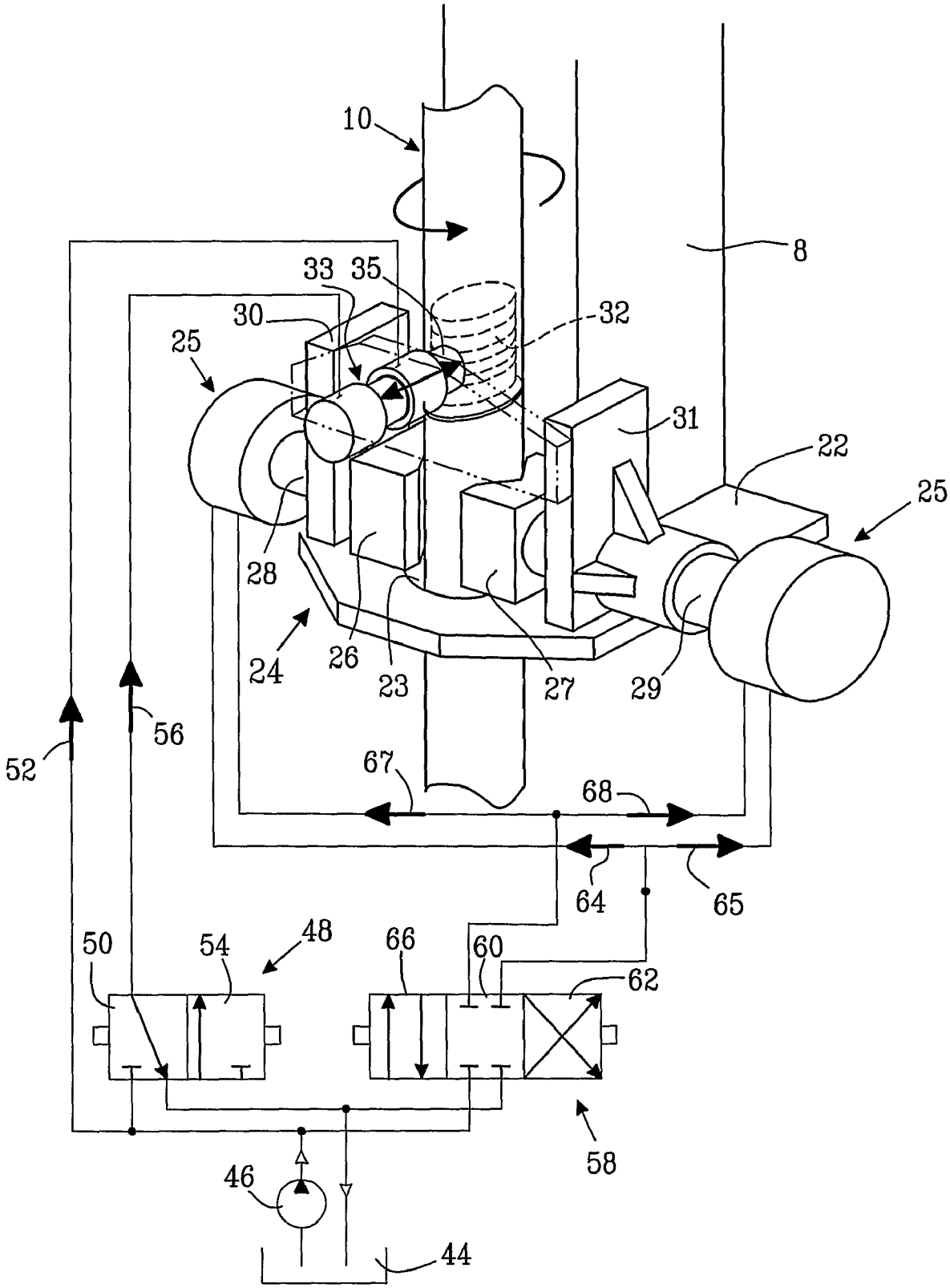

FIG. 2*a* is a perspective view of a slacking off device according to the present invention with a wiring scheme showing how the slacking off device is controlled by means of hydraulics.

Figure 2B:
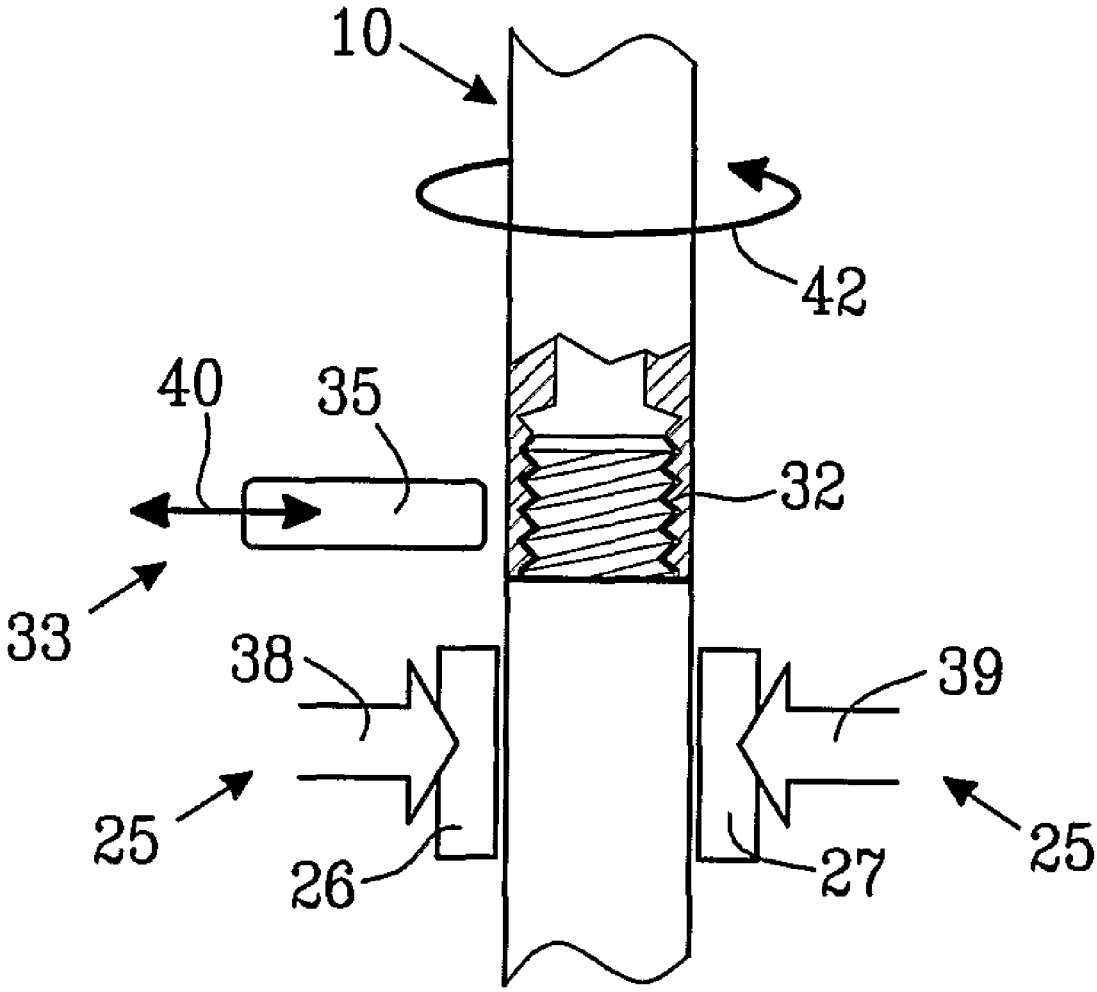

FIG. 2*b* is a schematic side view of a slacking off device according to the present invention.

DETAILED DESCRIPTION

A number of embodiments of the present invention will now be disclosed even if the invention is not limited to these.

FIG. 1 shows a drilling device 2 for rock drilling according to the present invention. The drilling device 2 comprises a rock drill 4 arranged on a carriage 6 that is movable along at least on feeding beam 8 in the usual manner. The drill 4 is in that way movable backwards and forwards along the feeding beam 8.

To the drill 4 a drill string 10 is adapted to be jointed. The drill string 10 comprises an arbitrary number of drill strings 12, 14 and 16. A typical drill rod may be 6 m long, but may be shorter or extend up to ca 10 meters. The diameter of a typical drill string is ca 38-87 mm. The drill string 10 also comprises a shank adapter 18 in one of its ends and a drill bit 20 in its other end and in-between the drill rods 12, 14 and 16 are arranged. The shank adapter 18 is in one of its ends arranged on drill 4 and in its other end adapted to be jointed with the drill rod 12 in a thread joint. The drill rods 12, 14 and 16 are adapted to be jointed together with thread joints. Each drill rod 12, 14 and 16 has a male thread in one of its ends and a female thread in its other end so that each drill rod on one of its sides may be jointed together with its male thread with the female thread of another drill rod and on the other side may be jointed together with its female thread with the male thread of another drill rod. In the other end of the drill rod 16, the drill bit 20 is adapted to be jointed in a thread joint. When almost all of the drill string is drilled into the rock 21, the drill string 10 is elongated to be able to continue to drill deeper into the rock. This is accomplished with one drill rod at a time by slacking the drill string 10 off the shank adapter 18 and another drill rod being screwed to the drill string 10 and to the shank adapter 18. This means that the drill string may be elongated to a length that commonly is ca 50 meters long and up to ca 100 meters. When drilling is completed, the drill rods are slackened one at a time. One common way is that the thread joint that joins drill rod 12 with the shank adapter 18 first are slackened and then tightened with a small torque that later should be easy to slacken. Thereafter the joint that joins the drill rod 12 with the drill rod 14 is feed and slackened, where after the joint between shank adapter 18 and drill rod 12 easily is slackened so that the drill rod 12 may be removed. Thereafter the shank adapter 18 is screwed to the drill rod 14 with a small torque that later should be easy to slacken and the thread joint between the drill rod 14 and the drill rod 16 is feed forward to be slackened etc. At least one drill support 22 is arranged at the front end of the feeding beam 8 to guide the drill string at drilling, which drill support 22 comprises a hole 23, see FIG. 2*a*, through which the drill string 10 is adapted to run. The drill 4 comprises a striking apparatus (not shown) adapted to expose the drill string 10 for strikes in the longitudinal direction of the drill string 10 and a driving device (not shown) for driving of forward and back rotation of the drill string 10. A common speed of rotation at drilling is 50 r.p.m. The drilling device in arranged on a movable carrier e.g. a drill rig (not shown). An operator may control drilling e.g. from a control panel on the drill rig or e.g. guide by remote control from a control panel above ground by means of a viewing screen by the control panel that shows the drilling device 2 filmed by a video camera arranged on the drilling device, at drilling below ground or from a control panel in another suitable place.

Slacking off of the thread joints takes place both at drilling when the drill string 10 is to be extended with additional drill rods 14, 16 and 18 and when drilling of the drill hole is completed at dismounting of the drill rods 14, 16 and 18 of the drill string 10. To facilitate the slacking off of the thread joints, the drilling device 4 comprises a slacking off device 24 according to the present invention which is shown in FIG. 2*a*.

The slacking off device 24 comprises a damping device 25 which is arranged on the drilling device 2 in a suitable way e.g. in the close vicinity of or on the drill support 22 as is shown in FIG. 2*a*, in close vicinity of or on the feeding beam 8. The damping device, that may be of suitable kind, may e.g. comprise at least one collet jaw. In the embodiment in FIG. 2*a*, the damping device 2 has collet jaws 26, 27 where each collet jaw 26, 27 comprises a damping area with a profile that is V-shaped, the profile may also be e.g. U-shaped or have another profile that provides a good grip around the drill string 10. The collet jaws 26 and 27 may e.g. be arranged on one cylinder 28 and 29 each that runs through holder 30 and 31 arranged on the drill support 22, preferably in dose vicinity to the hole 23. The collet jaws 26 and 27 are arranged on one side each of the hole 23 in a suitable place, e.g. opposite each other so that the may move in a principally inward radial movement towards the drill string 10 running through the hole 23 and clamp this up. The drill string 10 may advantageously be damped up dose to a first thread joint 32 that is to be slackened. The clamping device 25 is controlled in a suitable way, e.g. pneumatically or hydraulically, which may take place automatically by means of software, from a control panel by an operator or in another way.

The slacking off device 24 also comprises a striking device 33 arranged to strike on the drill string with the object of decreasing the torque required to be impressed on the drill string in order to be able to unscrew the thread joint. The use of striking against the joint, decreases this torque from ca 10000 Nm to ca 3000-4000 Nm. It is advantageous if the striking device 33 strikes dose to, especially on, the first thread joint 32 that is to be slackened. The striking device 33 is of suitable kind, e.g. a hammer 35, a hammer drill, a striking device, an eccentric that generates strikes etc. The striking device 33 is arranged at the drilling device 2 in a suitable place, e.g. at the front end of the feeding beam 8, on the drill support 22, in connection to the drill support 22 or the feeding beam 8 or in another way.

The striking device 33 may e.g. be screwed to the drill support 22 or may be built into the drill support 22. In FIG. 2*a* one embodiment is shown with a hammer 35 arranged in a cylinder 37 so that its movement is guided by the cylinder 37. The hammer 35 is arranged to that it strikes with an angle towards the longitudinal direction of the drill string 10 of principally 75°-105°, preferably 85°-95°, especially principally 90° on the first thread joint 32. The striking device 33 may for example strike with a striking energy of 20-200 joule per strike, preferably 100 joule per strike and a striking frequency of 5 Hz and more, preferably 10 Hz. The striking device 33 is controlled in a suitable way, e.g. pneumatically or hydraulically which may take place automatically by means of software, from a control panel by an operator or in another way.

To hold the drill string when a drill rod is screwed off and to obtain stability when the drill string 10 is damped up and exposed to striking, the striking device 33 is separate from the clamping device 25, i.e. it is not any of the collet jaws 26 and 27 that both clamps and strikes. Instead, the clamping device 25 clamps up the drill string 10 in one place so that the drill string is held stably during striking and is not at risk of being dropped. The striking device 33 then strikes on the drill string 10 in another place. The clamping device 25 preferably clamps around the rod that is adjacent to the rod that is to be removed so that the damping device 25 can hold the drill string 10, so that the drill string 10 does not fall back into the drill hole while the slackened drill rod is removed. It is advantageous if the striking device 33 strikes on the joint on the drill rod with the female thread. One example of how the striking device 33 and the damping device 25 thus cooperates is shown in FIG. 2*b*, where the collet jaws 26 and 27 damps up the drill string 10 with forces shown by the arrows 38 and 39, advantageously close to the first thread joint 32 and the hammer 35 knocks on the first thread joint 32 with movements shown by the arrow 40. The clamping device 25 clamps in principally radial direction against drill string 10 on diametrically opposed sides of the drill string and the striking device 33 advantageously strikes with an angle towards the longitudinal direction of the drill string 10 of especially principally 90° on the first thread joint 32. The damping device 25 and the striking device 33 are preferable arranged so close to each other that the two devices both may clamp up and strike on the drill string 10 in the thread joint area, i.e. the area where the thread joint is and the area that is close to the thread joint, preferably clamp the drill string 10 so close to the first thread joint 32 that the striking device gets space to strike on or dose to the first thread joint 32. The clamping device 25 and the striking device 33 may cooperate in different ways, e.g. the clamping direction and the striking direction may be principally perpendicular to each other as is shown in FIG. 2*a* or the striking direction may be parallel with the direction of movement of one of the collet jaws 26 as is shown in FIG. 2*b* or in another suitable way. At striking against the drill string 10, a torque is impressed on the drill string of ca 3000-4000 Nm in the thread slacking rotation direction in order to obtain slacking off of the first thread joint 32. This magnitude of torque is required after drilling is completed as it is at drilling with large torques on the drill string that the really considerable tightening of the thread joints occurs. A somewhat less torque is required at the extension of the drill string 10, i.e. when the drill strings have been that considerably tightened during the then shorter drill time. The torque for slacking off is obtained e.g. by the driving device driving the drill string 10 in back rotation, which back rotation is shown by the arrow 42 in FIG. 2*b*.

In conclusion, at slacking off of the drill string 10 for elongation with another drill rod at drilling or after completed drilling when the thread joints in the long drill string are to be slackened, i.e. a number of jointed drill rods 12, 14, 16 are to be dismounted, the drill string 10 is advantageously placed in the thread joint area i.e. so that the damping device 25 clamps up the drill string 10 dose to a first thread joint 32 that is to be slackened. The striking device 33 then strikes preferably on the first thread joint 32 that is to be slackened under simultaneous back rotation of the drill string 10. The slacking off device 24 may easily be controlled in a suitable way, e.g. pneumatically or hydraulically.

In FIG. 2*a* is schematically shown how one embodiment of the slacking off device 24 according to the invention is controlled by means of hydraulics. By means of the hydraulic tank 44 and the hydraulic pump 46 hydraulic fluid is circulated in the hydraulic system.

The valve 48 controls the striking device 33. In a rest position, when the striking device 33 is not striking, the valve is in the position shown in FIG. 2*a*, i.e. in position 50. Hydraulic fluid then circulates according to the arrow 52 and places the hammer 35 in a position, distant from the drill string 10. When the hammer 35 is about to strike, the valve 48 is moved to the left to a position 54 when hydraulic fluid circulates according to the arrow 56, which hydraulic fluid guides the hammer 35 to the drill string 10 thereafter the valve 48 is moved to the right back to position 50 so that the hammer 35 again is moved away from the drill string 10. The valve 48 is moved back and forth between the positions 50 and 54 with the frequency that makes the hammer to strike on the drill string 10 with the desired striking frequency. (See above). When the hammer is about to stop striking, the valve is placed in its rest position 50 when the hammer is distant from the drill string 10.

The valve 58 controls the clamping device 25. In a rest position 60 no hydraulic fluid circulates to or from the clamping device 25, this position is shown in FIG. 2*b*. To damp up the drill string 10, the valve 60 is moved to the left to position 62. Hydraulic fluid then circulates according to the directions of arrows 64 and 65 that brings the collet jaws 26 and 27 to the drill string 10 so that it damps up. To remove the collet jaws 26 and 27 from the drill string 10, the valve 60 is moved to the right to position 66. Hydraulic fluid then circulates according to the directions of arrows 67 and 68 that brings the collet jaws 26 and 27 away from the drill string 10 so that it is slackened. The valve 58 may then be brought back to the rest position 60.

The valves 48 and 58 are controlled by means of signals e.g. automatically by means of electrical signals and software, from e.g. the control panel by the operator or in another suitable way. In another embodiment of the present invention, the slacking off device 24 is controlled by means of pneumatics in a similar way, but here the hydraulic fluid is replaced with air.

This gives a simple and stable solution for slacking off of thread joints in drill strings at rock drilling.

The above disclosed embodiments are only for illustrative purpose and shall not be seen as limitations. It is obvious for the person skilled in the art that deviations may be made from the above disclosed embodiments without departing from the invention's scope and meaning. The scope of the invention shall not be regarded as limited to the above disclosed examples but shall instead be regarded as equivalent with the following claims.

The invention claimed is:

1. Slacking off device (24) for use at a drilling device (2) for rock drilling, which drilling device (2) comprises a rock drill (4) to which a drill string (10) is adapted to be jointed by means of a thread joint, said drill string (10) comprising an arbitrary number of drill rods (12, 14, 16) adapted to be jointed together by means of thread joints, said drilling device (2) comprising a driving device for forward and back rotation of the drill string (10), characterized in that the slacking off device (24) comprises:

a clamping device (25) arranged to clamp up the drill string (10), and a separate striking device (33) adapted to strike, using an angle towards the longitudinal direction of the drill string (10) of principally 75°-105°, on a first (32) of any of said thread joints during back rotation, such that an impressed torque on the drill string (10) is obtained in a thread slacking rotation direction, to provide slacking of the first thread joint (32).

2. Slacking off device (24) according to claim 1, wherein the clamping device (25) clamps up in principally radial direction towards the drill string (10).

3. Slacking off device (24) according to claim 2, wherein the clamping device (25) comprises two opposite side collet jaws (26, 27), where each collet jaw (26, 27) comprises a clamping area.

4. Slacking off device (24) according to claim 2, wherein the striking movement of the striking device (33) and the radial clamping direction of the clamping device (25) are principally perpendicular to each other.

5. Slacking off device (24) according to claim 1, wherein the clamping device (25) comprises two opposite side collet jaws (26, 27), where each collet jaw (26, 27) comprises a clamping area.

6. Slacking off device (24) according to claim 5, wherein the profile of the clamping area is V-shaped or U-shaped.

7. Slacking off device (24) according to claim 1, wherein the clamping device (25) is pneumatic or hydraulic controlled.

8. Slacking off device (24) according to claim 1, wherein the striking device (33) is represented by a hammer (35).

9. Slacking off device (24) according to claim 1, wherein the striking device (33) is pneumatic or hydraulic controlled.

10. Slacking off device (24) according to claim 1, wherein the striking device (33) strikes using an angle towards the longitudinal direction of the drill string (10) of principally 85°-95°.

11. Slacking off device (24) according to claim 10, wherein the striking device (33) strikes using an angle towards the longitudinal direction of the drill string (10) of principally 90°.

12. Slacking off device (24) according to claim 1, wherein the striking device (33) strikes with a striking energy of 20-200 joule per strike.

13. Drilling device (2) for rock drilling which drilling device (2) comprises a rock drill (4) to which a drill string (10) is adapted to be jointed by means of a thread joint, said drill string comprising an arbitrary number of drill rods (12, 14, 16) adapted to be jointed together by means of thread joints, said drilling device (2) comprises a driving device for forward and back rotation of the drill string (10), characterized in that the drilling device (2) comprises a slacking off device (24) according to claim 1.

14. Drilling device (2) according to claim 13, comprising at least one feeding beam (8) along which the drill (4) is movable and at least one drill support (22) arranged at the feeding beam (8) at which drill support (22) said clamping device (25) is arranged.

15. Drilling device (2) according to claim 13, wherein said striking device (33) is arranged at the drill support (22).

16. Drilling device (2) according to claim 13, wherein the clamping device (25) is arranged to clamp up the drill string (10) close to one of said thread joints.

17. Method for slacking a thread joint at rock drilling with a drilling device (2) according to claim 13, characterized in that the method comprises the steps of:

clamping the drill string (10) by means of the clamping device (25), the striking device (33) strikes on the drill string (10) in the area of a first thread joint (32) to be slackened and exposing the drill string (10) to a moment in a thread slacking rotation direction.

18. Method according to claim 17, wherein the clamping device (25) clamps up in principally radial direction against the drill string (10).

19. Method according to claim 18, wherein the striking movement of the striking device (33) and the radial clamping direction of the clamping device (25) are principally perpendicular to each other.

20. Method according to claim 17, wherein the striking device (33) strikes with an angle towards the longitudinal direction of the drill string (10) of principally 85°-95°.

21. Method according to claim 20, wherein the striking device (33) strikes with an angle towards the longitudinal direction of the drill string (10) of principally 90°.

22. Method according to claim 17, wherein the striking device (33) strikes with a striking energy of 20-200 joule per strike.

23. Method for slacking a thread joint at rock drilling with a drilling device (2) according to claim 14, characterized in that the method comprises the steps of:

clamping the drill string (10) by means of the clamping device (25), the striking device (33) strikes on the drill string (10) in the area of a first thread joint (32) to be slackened and exposing the drill string (10) to a moment in a thread slacking rotation direction.

24. Method for slacking a thread joint at rock drilling with a drilling device (2) according to claim 14, characterized in that the method comprises the steps of:

clamping the drill string (10) by means of the clamping device (25), the striking device (33) strikes on the drill string (10) in the area of a first thread joint (32) to be slackened and exposing the drill string (10) to a moment in a thread slacking rotation direction.

25. Method for slacking a thread joint at rock drilling with a drilling device (2) according to claim 15, characterized in that the method comprises the steps of:

clamping the drill string (10) by means of the clamping device (25), the striking device (33) strikes on the drill string (10) in the area of a first thread joint (32) to be slackened and exposing the drill string (10) to a moment in a thread slacking rotation direction.

* * * * *

UNITED STATES PATENT AND TRADEMARK OFFICE

CERTIFICATE OF CORRECTION

PATENT NO. : 7,740,060 B2
APPLICATION NO. : 12/084593
DATED : June 22, 2010
INVENTOR(S) : Lars Persson It is certified that error appears in the above-identified patent and that said Letters Patent is hereby corrected as shown below:

Column 7, Line 34 (Claim 15, Line 2): Delete "the", and substitute --a--.

Column 8, Line 27 (Claim 24, Line 2): Delete "14", and substitute --15--.

Column 8, Line 37 (Claim 25, Line 2): Delete "15", and substitute --16--.

Signed and Sealed this

Seventeenth Day of August, 2010

David J. Kappos

David J. Kappos
*Director of the United States Patent and Trademark Office*